US005427818A

United States Patent [19]

Tong et al.

[11] Patent Number: 5,427,818

[45] Date of Patent: Jun. 27, 1995

[54] ANTIGLARE/ANTISTATIC COATING FOR CRT

[75] Inventors: Hua-Sou Tong, Arlington Heights, Ill.; Chun-Min Hu, Keelung, Taiwan

[73] Assignee: Chunghwa Picture Tubes, Ltd., Taoyuan, Taiwan

[21] Appl. No.: 288,817

[22] Filed: Aug. 11, 1994

Related U.S. Application Data

[62] Division of Ser. No. 151,155, Nov. 12, 1993, Pat. No. 5,404,073.

[51] Int. Cl.[6] ..... B05D 5/06; B05D 5/12

[52] U.S. Cl. ..... 427/68; 427/240; 427/299; 427/379; 427/419.6

[58] Field of Search ..... 313/478, 479; 348/834; 427/68, 240, 299, 379, 419.6

[56] References Cited

U.S. PATENT DOCUMENTS

| | | | |
|---|---|---|---|
| 2,612,611 | 9/1952 | Szegho et al. | 250/80 |
| 2,680,205 | 6/1954 | Burton | 313/92 |
| 2,734,142 | 2/1956 | Barnes | 313/92 |
| 2,977,412 | 3/1961 | Rhodes et al. | 178/7.85 |
| 3,689,312 | 9/1972 | Long et al. | 117/94 |
| 4,468,702 | 8/1984 | Jandrell | 358/245 |
| 4,563,612 | 1/1986 | Deal et al. | 313/478 |
| 4,785,217 | 11/1988 | Matsuda et al. | 313/479 |
| 4,884,006 | 11/1989 | Prazak | 313/474 |
| 4,885,501 | 12/1989 | Tong | 313/402 |
| 4,945,282 | 7/1990 | Kawamura et al. | 313/479 |
| 5,011,443 | 4/1991 | Park | 445/2 |
| 5,122,709 | 6/1992 | Kawamura et al. | 313/479 |
| 5,150,004 | 9/1992 | Tong et al. | 313/479 |
| 5,200,667 | 4/1993 | Iwasaki et al. | 313/478 |

*Primary Examiner*—Michael Lusignan
*Attorney, Agent, or Firm*—Emrich & Dithmar

[57] ABSTRACT

An antiglare/antistatic coating for a cathode ray tube (CRT) is applied to the outer surface of the CRT's faceplate and includes a first inner hygroscopic layer of silane, water, sulfuric acid and an alcohol mixture which may be applied by dipping, spinning or spraying. The coating further includes a second outer layer of silanes, water, acid, epoxy, and a coupling agent balanced with an alcohol mixture which is sprayed onto the first inner layer. The grounded first inner layer possesses high conductivity for antistatic protection, while the second outer layer, which possesses glass-like characteristics, provides antiglare protection by reducing the faceplate's reflectivity. The second outer layer dries as a hard porous coating which resists scratching and allows water vapor to penetrate into the first inner hygroscopic layer to maintain its high conductivity.

8 Claims, 1 Drawing Sheet

ANTIGLARE/ANTISTATIC COATING FOR CRT

CROSS REFERENCE TO RELATED APPLICATION

This is a divisional application under 37 CFR § 1.60 of prior application, Ser. No. 08/151,555; filed Nov. 12, 1993, now U.S. Pat. No. 5,404,073, for ANTIGLARE/ANTISTATIC COATING FOR CRT.

FIELD OF THE INVENTION

This invention relates generally to cathode ray tubes (CRTs) and is particularly directed to an antiglare and antistatic coating for, and method of applying same to, the glass faceplate of a CRT.

BACKGROUND OF THE INVENTION

The glass faceplate of a CRT is comprised of a dielectric material which operates as a capacitor in storing-up an electrostatic charge as a result of the high voltages applied to the CRT. For safety reasons, this charge must be dissipated to ground. The CRT's faceplate is frequently provided with an antistatic coating on a surface thereof for bleeding the charge to ground. Antistatic coatings currently in use are generally based on three different approaches. One approach employs conductive ions such as lithium silicates in the coating. Another approach employs semiconductor materials such as comprised of tin oxides. Still another approach is based upon the use of hygroscopic materials which include ions which tend to absorb water vapor which renders the material conductive. Advantages of this last approach include low cost and ease of application to the CRT's faceplate. Problems have been encountered with this type of antistatic coating at low humidities. For example, at low humidity the bleed resistance decreases to values which allow large charges to buildup on the CRT's faceplate resulting in an unsafe condition. In addition, these hygroscopic coatings are easily scratched, particularly at low relative humidity.

Another important CRT performance characteristic involves the reflectance of its glass faceplate. Reflected light on the faceplate makes it more difficult to view a video image produced by the CRT. Various approaches have been developed to reduce the loss of image contrast due to CRT faceplate glare which is caused by random scattering of reflected light. Two basic approaches have been adopted to reduce faceplate glare, one involving the use of anti-reflective coatings and the other employs the use of antiglare coatings. Anti-reflective coatings are based upon negative reflective light interference wherein reflected light coming from the coating surface and the glass surface under the coating cancel each other for minimizing light reflection. The advantage of this type of coating is that virtually no loss of resolution occurs, but it suffers from the disadvantage of high sensitivity to fingerprints, Antiglare coatings seek to reduce random scattering of reflected light. This type of coating results in a loss of video image resolution to a certain extent, but is insensitive to fingerprints.

The prior art has combined these two approaches to reduce glare and static charge by applying a double layer of fine tin oxide particles to the CRT's faceplate. The tin oxide particles, having a diameter of about 50 nm, are suspended in a solution of ethyl silicate and ethanol. Other approaches for providing antiglare and/or antistatic coatings for a CRT are disclosed in U.S. Pat. Nos. 4,563,612; 3,689,312 and 4,785,217. A primary disadvantage of these and other prior art approaches is the relatively high cost of preparing, processing and applying the one or more coatings to the CRT's faceplate.

The present invention addresses the aforementioned limitations of the prior art by providing a two layer antiglare/antistatic coating for use on the outer surface of the faceplate of a CRT which improves viewing of the CRT's video image and provides safer CRT operation.

OBJECTS AND SUMMARY OF THE INVENTION

Accordingly, it is an object of the present invention to provide an improved antiglare/antistatic coating for the faceplate of a CRT.

It is another object of the present invention to provide a novel method for applying a two layered coating onto the outer surface of the glass faceplate of a CRT which provides both antiglare and antistatic protection.

Yet another object of the present invention is to provide a multi-layer coating for the faceplate of a CRT which includes an inner hygroscopic layer having high conductivity for antistatic protection and a hard glass-like outer porous layer which is scratch-resistant and permits moisture access to the inner layer for maintaining its high conductivity while reducing faceplate reflectivity.

These objects of the present invention are achieved and the disadvantages of the prior art are eliminated in a CRT by a multi-layer coating on an outer surface of the CRT's glass faceplate, the multi-layer coating comprising: a first conductive grounded inner coating disposed on the outer surface of the faceplate, wherein the inner coating is hygroscopic for absorbing water vapor for maintaining high conductivity of said inner coating for directing an electrostatic charge on the faceplate to ground; and a second hard, glass-like outer coating disposed on the first inner coating for preventing scratching of the first inner coating and for reducing random scattering of light reflected from the faceplate, the second outer coating including a plurality of voids for permitting water vapor access to the first inner coating to maintain its high conductivity.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
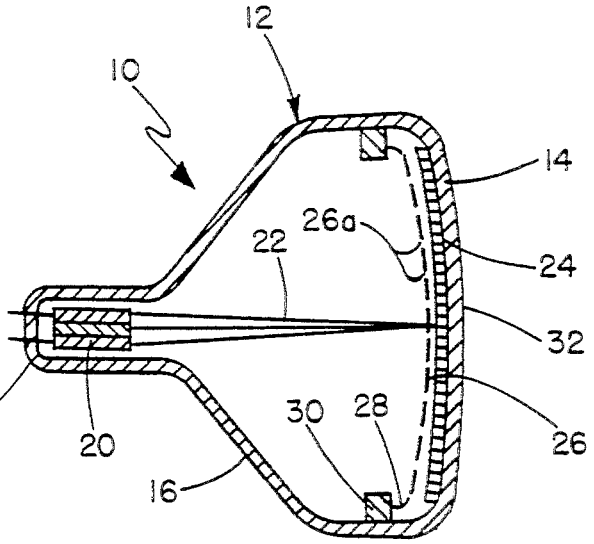
FIG. 1 is a sectional view of a color cathode ray tube incorporating an antiglare/antistatic coating in accordance with the principles of the present invention.

Referring to FIG. 1, there is shown a sectional view of a color CRT 10 incorporating an antiglare/antistatic coating 32 in accordance with the principles of the present invention. CRT 10 includes a sealed glass envelope 12 having a forward faceplate, or display screen, 14, an aft neck portion 18, and an intermediate funnel portion 16. Disposed on the inner surface of glass faceplate 14 is a phosphor screen 24 which includes a plurality of discrete phosphor deposits, or elements, which emit light when an electron beam is incident thereon to produce a video image on the faceplate 14. Disposed in the neck portion 18 of the CRT's glass envelope 12 are a plurality of electron guns 20 typically arranged in an inline array for directing a plurality of electron beams 22 onto phosphor screen 24. The electron beams 22 are deflected vertically and horizontally in unison across the phosphor screen 24 by a magnetic deflection yoke which is not shown in the figure for simplicity. Disposed in a spaced manner from phosphor screen 24 is a shadow mask 26 having a plurality of spaced electron beam passing apertures 26a and a skirt portion 28 around the periphery thereof. The shadow mask skirt portion 28 is securely attached to a shadow mask mounting fixture 30 around the periphery of the shadow mask. The shadow mask mounting fixture 30 is attached to an inner surface of the CRT's glass envelope 12 and may include conventional attachment and positioning structures such as a mask attachment frame and a mounting spring which also are not shown in the figure for simplicity. The shadow mask mounting fixture 30 may be attached to the inner surface of the CRT's glass envelope 12 and the shadow mask 26 may be attached to the mounting fixture by conventional means such as weldments or a glass-based frit.

Figure 2:
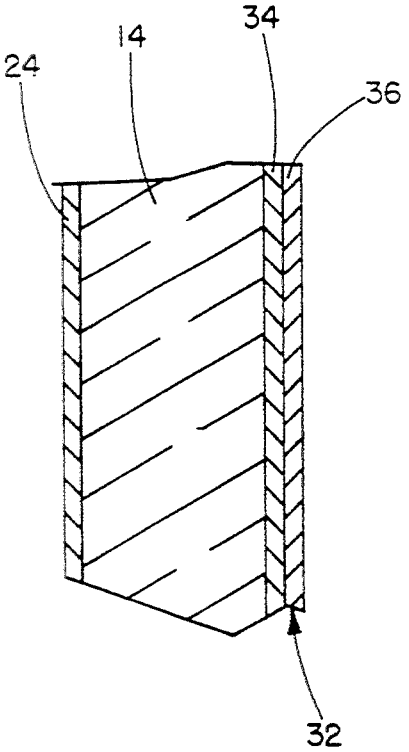
FIG. 2 is a partial sectional view showing an antiglare/antistatic coating in accordance with the present invention disposed on the outer surface of a CRT's faceplate.

In accordance with the present invention and with reference also to the sectional view of FIG. 2, an antiglare/antistatic coating 32 is disposed on the outer surface of the CRT's glass faceplate 14. Disposed on the inner surface of glass faceplate 14 is the aforementioned phosphor screen 24. The antiglare/antistatic coating 32 includes a first inner antistatic layer, or coating, 34 and a second outer antiglare layer 36. The first inner antistatic layer 34 is preferably comprised of 1–8 weight % of silane (including tetraalkyl silane, tetraaryl silane and halogenated silane); 0.1–20 weight % of water; 0.1–5 weight % of sulfuric acid; and a mixture of alcohol with the general formula $C_nH_{2n}+10H$, where n=1 to 4, for balancing the first inner antistatic layer. The antistatic properties of the first inner layer 34 arise from the hygroscopicity of the sulfuric acid within the layer which causes the antistatic layer to absorb water vapor and exhibit high conductivity. However, the sulfuric acid in the first inner antistatic layer 34 renders it highly susceptible to scratching which would degrade a video image presented on the CRT's glass faceplate 14. To provide an effective antistatic capability on the CRT's faceplate 14, the first inner antistatic layer 34 exhibits a resistivity of on the order of $10^9$ ohms per unit area.

In applying the first inner antistatic layer 34 to the CRT's glass faceplate 14, the faceplate is first cleaned using a conventional cleansing agent such as cerium oxide followed by thorough rinsing of the faceplate. The faceplate is then preheated to a temperature in the range of 60°–100° C. prior to applying the first inner antistatic layer 34 to the outer surface of the faceplate. The first inner antistatic layer 34 is applied to the faceplate 14 either by dipping, spinning, or spraying the coating onto the faceplate. The first inner antistatic layer 34 is applied to the faceplate's outer surface so as to be in contact with a grounded implosion protection band disposed about the faceplate. In another embodiment, conducting tape may be used to electrically couple the first inner antistatic layer 34 to the implosion protection band for the purpose of grounding the antistatic layer. Neither the implosion protection band or conducting tape for electrically coupling the antistatic layer to the implosion protection band are shown in the figures as these components as contemplated for use with the present invention are conventional in design and operation.

After applying the first inner antistatic layer 34 to the faceplate's outer surface, the coated faceplate is then aged either at room temperature or is maintained at a temperature in the range of 60°–100° C. to allow for drying and hardening of the antistatic layer. The second outer antiglare layer 36 is then applied over the first inner antistatic layer 34 at a temperature in the range of 60°–100° C. using a conventional spraying method. The preferred composition of the second outer antiglare layer 36 is 0.1–8 weight % silane (including tetraalkyl silanes, tetraaryl silanes, and halogenated silanes); 0.1–50 weight % of water; 0.1–3.0 weight % of nitric acid; 0.1–7 weight % of hydrochloric acid; 0.1–2.0 weight % of sulfuric acid; 0.1–2.0 weight % organo epoxy; 0.1–0.5 weight % of a coupling agent (such as beta-(3,4-epoxycyclohexyl) ethyltrimethoxysiane); and an alcohol mixture of $C_nH_{2n}+10H$, where n=1 to 4, for balancing the antiglare layer. After applying the second outer antiglare layer 36 over the first inner antistatic layer 34, the faceplate and coatings are then post-baked at a temperature in the range of 100°–180° C. for a period of 15–60 minutes. The coated faceplate is then cooled down to room temperature in air. The second outer antiglare layer 36 reduces random scattering of reflected light from the CRT's glass faceplate 14 as well as from the first inner antistatic layer 34 and affords excellent abrasion resistance for protecting the first inner antistatic layer from scratching.

Figure 3:
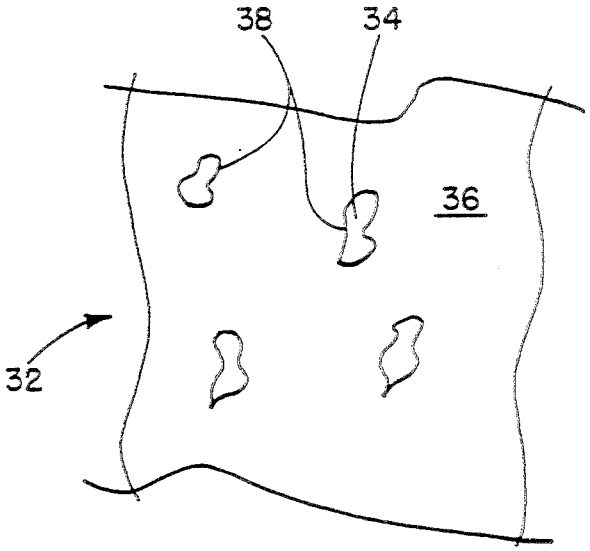
FIG. 3 is a simplified plan view of a portion of the inventive antiglare/antistatic coating of the present invention.

When the faceplate 14 and the antistatic and antiglare layers 34, 36 are post-baked at a temperature in the range of 100°–180° C. from 15–60 minutes, microscopic pores 38 form in the second outer antiglare layer 36 as shown in the plan view of a portion of the antiglare/antistatic coating 32 of FIG. 3. The microscopic pores 38 expose portions of the first inner antistatic layer 34 to the atmosphere permitting the hygroscopic antistatic layer to absorb water vapor from the atmosphere. The absorbed water vapor maintains the high conductivity of the first inner antistatic layer 34 for effective grounding of electrostatic charge on the CRT's faceplate 14 even at low relative humidities. A CRT faceplate coated with the antistatic and antiglare layers described above exhibits an electrical resistance of approximately $10^7$–$10^8$ ohms and a gloss value of 45–55%. These values were achieved even after environmental testing of the faceplate in an atmosphere of relative humidity and 25° C. for 288 hours. The resultant electrical resistivity stabilized after 96 hours and remained at approximately 109 ohms throughout the test.

There has thus been shown an antiglare/antistatic coating for a CRT applied to the outer surface of the CRT's faceplate for safely discharging electrostatic charge to ground and reducing random scattering of light reflected from the faceplate for improved video image viewing. The antiglare/antistatic coating includes a first inner antistatic layer disposed on the faceplate's outer surface and a second outer antiglare layer disposed on the inner antistatic layer. The first inner antistatic layer is comprised of a hygroscopic material which tends to absorb water vapor for maintaining a high conductivity for antistatic protection. The second outer antiglare layer provides a hard, glass-like coating for the softer antistatic layer which protects the antistatic layer from scratching and provides antiglare protection by reducing the faceplate's reflectivity. The second outer antiglare layer dries as a hard porous coating which resists scratching and allows water vapor to penetrate into the first inner hygroscopic layer to maintain its high conductivity.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A method for applying an antiglare/antistatic coating to an outer surface of a faceplate of a cathode ray tube, said method comprising the steps of:

cleaning the outer surface of said faceplate;

preheating said faceplate at a first temperature;

applying a first layer of a conductive hygroscopic coating to the outer surface of said faceplate and coupling said first layer to neutral ground potential, wherein said hygroscopic coating is adapted for absorbing water vapor for maintaining a high conductivity;

allowing said first layer to dry;

heating said faceplate at a second temperature and applying a second layer of a hard, glass-based coating to said first layer, wherein said second temperature is equal to or greater than said first temperature, and wherein said glass-based coating protects said first layer from scratching and reduces random scattering of light reflected from said faceplate; and heating said faceplate and said first and second coating layers thereon at a third temperature for forming pores in said second layer to permit access of atmospheric water vapor to said first layer for maintaining its high conductivity, wherein said third temperature is greater than said first and second temperatures.

2. The method of claim 1 wherein the step of cleaning the outer surface of said faceplate includes cleaning the faceplate with cerium oxide followed by a rinsing with water.

3. The method of claim 2 wherein the step of preheating said faceplate at a first temperature includes preheating to a temperature in the range of 60°–100° C.

4. The method of claim 3 wherein the step of allowing said first layer to dry includes heating said faceplate and said first layer to a temperature in the range of 60°–100° C. until dry.

5. The method of claim 4 wherein said second temperature is in the range of 60°–100° C.

6. The method of claim 5 wherein the step of heating said faceplate and said first and second coating layers to a third temperature includes heating to a temperature in the range of 100°–180° C. for 15–60 minutes.

7. The method of claim 1 wherein said first layer of hygroscopic coating is applied by dipping, spinning or spraying.

8. The method of claim 7 wherein said second layer of a hard, glass-based coating is applied by spraying.

* * * * *

UNITED STATES PATENT AND TRADEMARK OFFICE

CERTIFICATE OF CORRECTION

PATENT NO. : 5,427,818
DATED : June 27, 1995
INVENTOR(S) : Hua-Sou Tong and Chun-Min Hu It is certified that error appears in the above-indentified patent and that said Letters Patent is hereby corrected as shown below:

In column 3, line 67, delete the "." after the "C".

In column 4, line 19, delete the "." after the "C".

In column 4, line 23, delete the "." after the "C".

In column 4, line 36, delete the "." after the "C".

In column 4, line 46, delete the "." after the "C".

In column 4, line 61, insert --21%-- after the words "atmosphere of".

In column 4, line 62, delete the "." after the word "C".

Signed and Sealed this

Twelfth Day of September, 1995

*Attest:*

Bruce Lehman

BRUCE LEHMAN

*Attesting Officer*

*Commissioner of Patents and Trademarks*